US008651203B2

(12) United States Patent
DiGiovanni

(10) Patent No.: US 8,651,203 B2
(45) Date of Patent: Feb. 18, 2014

(54) POLYCRYSTALLINE COMPACTS INCLUDING METALLIC ALLOY COMPOSITIONS IN INTERSTITIAL SPACES BETWEEN GRAINS OF HARD MATERIAL, CUTTING ELEMENTS AND EARTH-BORING TOOLS INCLUDING SUCH POLYCRYSTALLINE COMPACTS, AND RELATED METHODS

(75) Inventor: Anthony A. DiGiovanni, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 276 days.

(21) Appl. No.: 13/029,930

(22) Filed: Feb. 17, 2011

(65) Prior Publication Data

US 2012/0211283 A1 Aug. 23, 2012

(51) Int. Cl.
*E21B 10/46* (2006.01)
*C22C 32/00* (2006.01)

(52) U.S. Cl.
USPC ..... 175/428; 419/10

(58) Field of Classification Search
None
See application file for complete search history.

(56) References Cited

U.S. PATENT DOCUMENTS

| | | | |
|---|---|---|---|
| 4,995,887 | A | 2/1991 | Barr et al. |
| 5,747,395 | A | 5/1998 | Smith et al. |
| 6,544,308 | B2 | 4/2003 | Griffin et al. |
| 6,566,462 | B2 | 5/2003 | Murray et al. |
| 6,589,640 | B2 | 7/2003 | Griffin et al. |
| 6,592,985 | B2 | 7/2003 | Griffin et al. |
| 6,739,214 | B2 | 5/2004 | Griffin et al. |
| 6,749,033 | B2 | 6/2004 | Griffin et al. |
| 6,797,326 | B2 | 9/2004 | Griffin et al. |
| 6,861,098 | B2 | 3/2005 | Griffin et al. |
| 6,861,137 | B2 | 3/2005 | Griffin et al. |
| 6,878,447 | B2 | 4/2005 | Griffin et al. |
| 2005/0115744 | A1 | 6/2005 | Griffin et al. |
| 2005/0129950 | A1 | 6/2005 | Griffin et al. |
| 2007/0092727 | A1 * | 4/2007 | Kosters et al. ..... 428/408 |
| 2007/0169419 | A1 | 7/2007 | Davis et al. |
| 2007/0202254 | A1 | 8/2007 | Ganguli et al. |

(Continued)

FOREIGN PATENT DOCUMENTS

WO 9509131 A1 4/1995

OTHER PUBLICATIONS

Conrads et al., Plasma Generation and Plasma Sources, Plasma Sources Sci. Technol., vol. 9 (2000), pp. 441-454.

(Continued)

*Primary Examiner* — Jennifer H Gay
*Assistant Examiner* — Caroline Butcher
(74) *Attorney, Agent, or Firm* — TraskBritt

(57) ABSTRACT

Polycrystalline compacts include a polycrystalline material comprising a plurality of inter-bonded grains of hard material, and a metallic material disposed in interstitial spaces between the inter-bonded grains of hard material. At least a portion of the metallic material comprises a metal alloy that includes two or more elements. A first element of the two or more elements comprises at least one of cobalt, iron, and nickel. A second element of the two or more elements comprises at least one of dysprosium, yttrium, terbium, gadolinium, germanium, samarium, neodymium, and praseodymium. The metal alloys may comprise eutectic or near-eutectic compositions, and may have relatively low melting points. Cutting elements and earth-boring tools include such polycrystalline compacts. Methods include the formation of such polycrystalline compacts, cutting elements, and earth-boring tools.

45 Claims, 6 Drawing Sheets

(56) References Cited

U.S. PATENT DOCUMENTS

| | | | | |
|---|---|---|---|---|
| 2008/0302579 | A1 | 12/2008 | Keshavan et al. | |
| 2010/0186304 | A1 | 7/2010 | Burgess et al. | |
| 2010/0199573 | A1 | 8/2010 | Montross et al. | |
| 2010/0243336 | A1* | 9/2010 | Dourfaye et al. | 175/434 |
| 2010/0300764 | A1 | 12/2010 | Naidoo et al. | |
| 2010/0326740 | A1* | 12/2010 | Hall et al. | 175/428 |
| 2012/0012402 | A1 | 1/2012 | Thigpen et al. | |

OTHER PUBLICATIONS

Xu et al., Liquid Metal Extraction of Nd from NdFeB Magnet Scrap, J. Mater. Res., vol. 15, No. 11, Nov 2000, pp. 2296-2304.

International Search Report for International Application No. PCT/US2012/025254 dated Oct. 30, 2012, 3 pages.

International Written Opinion for International Application No. PCT/US2012/025254 dated Oct. 30, 2012, 4 pages.

International Preliminary Report on Patentability for International Application No. PCT/US2012025254 dated Aug. 21, 2013, 5 pages.

* cited by examiner

POLYCRYSTALLINE COMPACTS INCLUDING METALLIC ALLOY COMPOSITIONS IN INTERSTITIAL SPACES BETWEEN GRAINS OF HARD MATERIAL, CUTTING ELEMENTS AND EARTH-BORING TOOLS INCLUDING SUCH POLYCRYSTALLINE COMPACTS, AND RELATED METHODS

FIELD

The present disclosure relates generally to polycrystalline compacts, which may be used, for example, as cutting elements for earth-boring tools, and to methods of forming such polycrystalline compacts, cutting elements, and earth-boring tools.

BACKGROUND

Earth-boring tools for forming wellbores in subterranean earth formations generally include a plurality of cutting elements secured to a tool body. For example, fixed-cutter earth-boring rotary drill bits (also referred to as "drag bits") include a plurality of cutting elements that are fixedly attached to a bit body of the drill bit. Similarly, roller cone earth-boring rotary drill bits may include cones that are mounted on bearing pins extending from legs of a bit body such that each cone is capable of rotating about the bearing pin on which it is mounted. A plurality of cutting elements may be mounted to each cone of the drill bit. In other words, earth-boring tools often include a body (e.g., a bit body or a cone) to which cutting elements are attached.

The cutting elements used in such earth-boring tools often include polycrystalline diamond compacts (often referred to as "PDC"), one or more surfaces of which may act as cutting faces of the cutting elements. Polycrystalline diamond material is material that includes interbonded grains or crystals of diamond material. In other words, polycrystalline diamond material includes direct, inter-granular bonds between the grains or crystals of diamond material. The terms "grain" and "crystal" are used synonymously and interchangeably herein.

Polycrystalline diamond compact cutting elements are typically formed by sintering and bonding together relatively small diamond grains under conditions of high temperature and high pressure in the presence of a catalyst (e.g., cobalt, iron, nickel, or alloys and mixtures thereof) to form a layer (e.g., a compact or "table") of polycrystalline diamond material on a cutting element substrate. These processes are often referred to as high-temperature/high-pressure (HTHP) processes. The cutting element substrate may comprise a cermet material (i.e., a ceramic-metal composite material) such as, for example, cobalt-cemented tungsten carbide. In such instances, the cobalt (or other catalyst material) in the cutting element substrate may be swept into the diamond grains during sintering and serve as the catalyst material for forming the inter-granular diamond-to-diamond bonds, and the resulting diamond table, from the diamond grains. In other methods, powdered catalyst material may be mixed with the diamond grains prior to sintering the grains together in an HTHP process.

Upon formation of a diamond table using an HTHP process, catalyst material may remain in interstitial spaces between the grains of diamond in the resulting polycrystalline diamond compact. The presence of the catalyst material in the diamond table may contribute to thermal damage in the diamond table when the cutting element is heated during use, due to friction at the contact point between the cutting element and the formation.

Polycrystalline diamond compact cutting elements in which the catalyst material remains in the polycrystalline diamond compact are generally thermally stable up to a temperature of about seven hundred fifty degrees Celsius (750° C.), although internal stress within the cutting element may begin to develop at temperatures exceeding about three hundred fifty degrees Celsius (350° C.). This internal stress is at least partially due to differences in the rates of thermal expansion between the diamond table and the cutting element substrate to which it is bonded. This differential in thermal expansion rates may result in relatively large compressive and tensile stresses at the interface between the diamond table and the substrate, and may cause the diamond table to delaminate from the substrate. At temperatures of about seven hundred fifty degrees Celsius (750° C.) and above, stresses within the diamond table itself may increase significantly due to differences in the coefficients of thermal expansion of the diamond material and the catalyst material within the diamond table. For example, cobalt thermally expands significantly faster than diamond, which may cause cracks to form and propagate within the diamond table, eventually leading to deterioration of the diamond table and ineffectiveness of the cutting element.

Furthermore, at temperatures at or above about seven hundred fifty degrees Celsius (750° C.), some of the diamond crystals within the polycrystalline diamond compact may react with the catalyst material causing the diamond crystals to undergo a chemical breakdown or back-conversion to another allotrope of carbon or another carbon-based material. For example, the diamond crystals may graphitize at the diamond crystal boundaries, which may substantially weaken the diamond table. In addition, at extremely high temperatures, in addition to graphite, some of the diamond crystals may be converted to carbon monoxide and carbon dioxide.

In order to reduce the problems associated with differential rates of thermal expansion and chemical breakdown of the diamond crystals in polycrystalline diamond compact cutting elements, so-called "thermally stable" polycrystalline diamond compacts (which are also known as thermally stable products, or "TSPs") have been developed. Such a thermally stable polycrystalline diamond compact may be formed by leaching the catalyst material (e.g., cobalt) out from interstitial spaces between the interbonded diamond crystals in the diamond table using, for example, an acid or combination of acids (e.g., aqua regia). All of the catalyst material may be removed from the diamond table, or catalyst material may be removed from only a portion thereof. Thermally stable polycrystalline diamond compacts in which substantially all catalyst material has been leached out from the diamond table have been reported to be thermally stable up to temperatures of about twelve hundred degrees Celsius (1,200° C.). It has also been reported, however, that such fully leached diamond tables are relatively more brittle and vulnerable to shear, compressive, and tensile stresses than are non-leached diamond tables. In addition, it is difficult to secure a completely leached diamond table to a supporting substrate. In an effort to provide cutting elements having polycrystalline diamond compacts that are more thermally stable relative to non-leached polycrystalline diamond compacts, but that are also relatively less brittle and vulnerable to shear, compressive, and tensile stresses relative to fully leached diamond tables, cutting elements have been provided that include a diamond table in which the catalyst material has been leached from a portion or portions of the diamond table. For example, it is known to leach catalyst material from the cutting face, from the side of the diamond table, or both, to a desired depth within the diamond table, but without leaching all of the catalyst material out from the diamond table.

BRIEF SUMMARY

In some embodiments, the present disclosure includes polycrystalline compacts. The polycrystalline compacts comprise a polycrystalline material including a plurality of inter-bonded grains of hard material, and a metallic material disposed in interstitial spaces between the inter-bonded grains of hard material. At least a portion of the metallic material comprises a metal alloy that includes two or more elements. A first element of the two or more elements comprises at least one of cobalt, iron, and nickel. A second element of the two or more elements comprises at least one of dysprosium, yttrium, terbium, gadolinium, germanium, samarium, neodymium, and praseodymium. The metal alloy may have a melting temperature of about seven hundred fifty degrees Celsius (750° C.) or less.

Additional embodiments of polycrystalline compacts include a polycrystalline material comprising a plurality of inter-bonded grains of hard material, and a metallic material disposed in interstitial spaces between the inter-bonded grains of hard material. At least a portion of the metallic material comprises a metal alloy having a near-eutectic composition of at least two elements. A first element of the at least two elements comprises at least one of cobalt, iron, and nickel. A second element of the at least two elements comprises at least one of dysprosium, yttrium, terbium, gadolinium, germanium, samarium, neodymium, and praseodymium.

Further embodiments of the disclosure include cutting elements that include a cutting element substrate, and a polycrystalline compact bonded to the cutting element substrate. The polycrystalline compact comprises a polycrystalline material including a plurality of inter-bonded grains of hard material, and a metallic material disposed in interstitial spaces between the inter-bonded grains of hard material. At least a portion of the metallic material comprises a metal alloy that includes two or more elements. A first element of the two or more elements comprises at least one of cobalt, iron, and nickel. A second element of the two or more elements comprises at least one of dysprosium, yttrium, terbium, gadolinium, germanium, samarium, neodymium, and praseodymium. The metal alloy may have a melting temperature of about seven hundred fifty degrees Celsius (750° C.) or less.

Additional embodiments of cutting elements include a cutting element substrate, and a polycrystalline compact bonded to the cutting element substrate. The polycrystalline compact includes a polycrystalline material comprising a plurality of inter-bonded grains of hard material, and a metallic material disposed in interstitial spaces between the inter-bonded grains of hard material. At least a portion of the metallic material comprises a metal alloy having a near-eutectic composition of at least two elements. A first element of the at least two elements comprises at least one of cobalt, iron, and nickel. A second element of the at least two elements comprises at least one of dysprosium, yttrium, terbium, gadolinium, germanium, samarium, neodymium, and praseodymium.

In additional embodiments, the present disclosure includes earth-boring tools that include cutting elements comprising polycrystalline compacts as described herein. For example, earth-boring tools of the disclosure may include a tool body, and at least one cutting element attached to the tool body. The at least one cutting element comprises a polycrystalline compact that includes a polycrystalline material comprising a plurality of inter-bonded grains of hard material, and a metallic material disposed in interstitial spaces between the inter-bonded grains of hard material. At least a portion of the metallic material comprises a metal alloy. The metal alloy comprises two or more elements. A first element of the two or more elements comprises at least one of cobalt, iron, and nickel. A second element of the two or more elements comprises at least one of dysprosium, yttrium, terbium, gadolinium, germanium, samarium, neodymium, and praseodymium.

In yet further embodiments, the present disclosure includes methods of fabricating polycrystalline compacts as described herein. An unsintered compact preform may be formed that comprises a plurality of grains of hard material. The compact preform may be sintered in the presence of a catalyst material for catalyzing the formation of inter-granular bonds between the grains of hard material of the plurality of grains of hard material. Sintering the compact preform may comprise forming a polycrystalline material comprising interbonded grains of hard material formed by bonding together the plurality of grains of hard material. A metal alloy may be provided in at least some interstitial spaces between the inter-bonded grains of hard material. The metal alloy may be formulated to comprise at least two elements. A first element of the at least two elements may be selected from the group consisting of cobalt, iron, and nickel. A second element of the at least two elements may be selected from the group consisting of dysprosium, yttrium, terbium, gadolinium, germanium, samarium, neodymium, and praseodymium.

BRIEF DESCRIPTION OF THE DRAWINGS

While the specification concludes with claims particularly pointing out and distinctly claiming what are regarded as embodiments of the present invention, various features and advantages of embodiments of the disclosure may be more readily ascertained from the following description of some embodiments of the disclosure when read in conjunction with the accompanying drawings, in which:

DETAILED DESCRIPTION

The illustrations presented herein are not actual views of any particular polycrystalline compact, microstructure of polycrystalline material, or earth-boring tool, and are not drawn to scale, but are merely idealized representations that are employed to describe embodiments of the disclosure. Additionally, elements common between figures may retain the same numerical designation.

The term "polycrystalline material" means and includes any material comprising a plurality of grains (i.e., crystals) of the material that are bonded directly together by inter-granular bonds. The crystal structures of the individual grains of the material may be randomly oriented in space within the polycrystalline material.

As used herein, the term "inter-granular bond" means and includes any direct atomic bond (e.g., covalent, metallic, etc.) between atoms in adjacent grains of material.

As used herein, the term "near-eutectic composition" means a composition of two or more elements, wherein the atomic percentage of each element in the composition is within seven atomic percent (7 at %) of the atomic percentage of that element in a eutectic composition of the two or more elements. Near-eutectic compositions of two or more elements include and encompass the eutectic compositions of the two or more elements. In other words, eutectic compositions are a subset of near-eutectic compositions.

Figure 1:
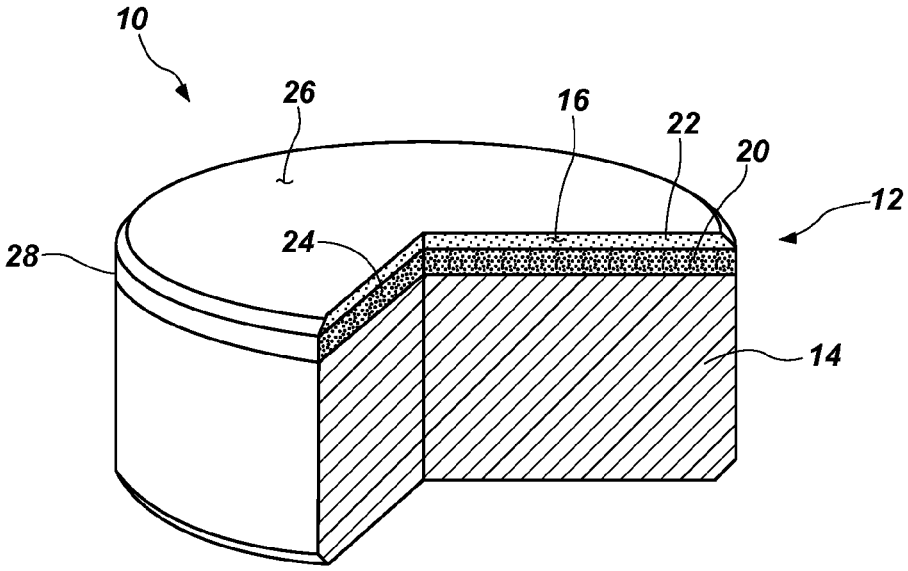
FIG. 1 is a partial cut-away perspective view illustrating an embodiment of a cutting element comprising a polycrystalline compact of the present disclosure, which includes two regions having materials of differing compositions in interstitial spaces between inter-bonded grains of hard material within the regions.
Figure 2:
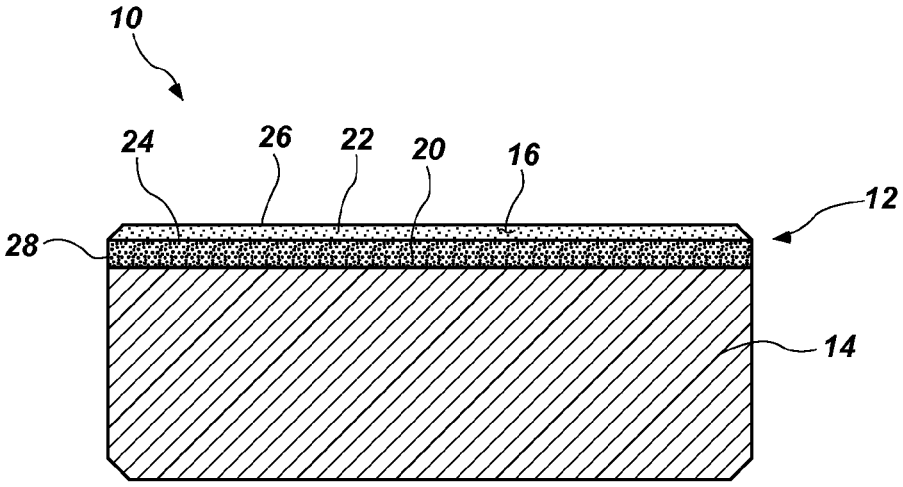
FIG. 2 is a cross-sectional side view of the cutting element shown in FIG. 1.

FIGS. 1 and 2 are simplified drawings illustrating an embodiment of a cutting element 10 that includes a polycrystalline compact 12 that is bonded to a cutting element substrate 14. The polycrystalline compact 12 comprises a table or layer of hard polycrystalline material 16 that has been provided on (e.g., formed on or secured to) a surface of a supporting cutting element substrate 14. The cutting element substrate 14 may comprise a cermet material such as cobalt-cemented tungsten carbide.

The hard polycrystalline material 16 comprises a plurality of inter-bonded grains of hard material. In some embodiments, the hard material comprises diamond. In other words, the hard polycrystalline material 16 may comprise polycrystalline diamond in some embodiments. In other embodiments, the hard polycrystalline material 16 may comprise polycrystalline cubic boron nitride.

Figure 3:
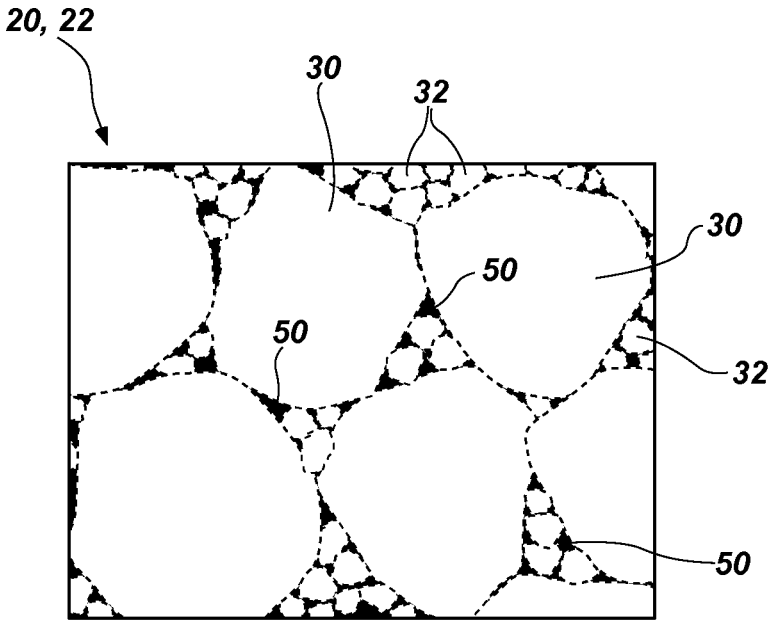
FIG. 3 is a simplified drawing showing how a microstructure of the polycrystalline compact of FIGS. 1 and 2 may appear under magnification.

Referring briefly to FIG. 3, as discussed in further detail below, a metallic material 50 (shaded black in FIG. 3) is disposed in interstitial spaces between inter-bonded grains 30, 32 of hard material in at least a portion of the hard polycrystalline material 16 of the polycrystalline compact 12. Further, at least a portion of the metallic material 50 comprises a metal alloy, the metal alloy comprising two or more elements. One element of the two or more elements of the metal alloy comprises one or more of cobalt, iron, and nickel. Another element of the two or more elements of the metal alloy comprises at least one of dysprosium, yttrium, terbium, gadolinium, germanium, samarium, neodymium, and praseodymium.

Referring again to FIGS. 1 and 2, in some embodiments, the polycrystalline compact 12 may include a plurality of regions having differing compositions of the metallic material 50 (FIG. 3) therein, as discussed in further detail below. By way of non-limiting example, the polycrystalline compact 12 may include a first region 20 and a second region 22, as shown in FIGS. 1 and 2. The second region 22 may be disposed adjacent the first region 20, and may be directly bonded to, and integrally formed with, the first region 20. In some embodiments, there may be an identifiable boundary or interface 24 between the first region 20 and the second region 22. For example, it may be possible to identify the boundary or interface 24 between the first region 20 and the second region 22 in the microstructure of the hard polycrystalline compact 12 when visualized under magnification, or otherwise analyzed (e.g., using chemical or microstructural analysis equipment and techniques known in the art). In other embodiments, however, the composition of the metallic material 50 (FIG. 3) disposed in interstitial spaces between the inter-bonded grains 30, 32 (FIG. 3) of hard material may vary in a continuous or gradual manner across the polycrystalline compact 12, such that there is no discrete, identifiable boundary or interface 24 between the first region 20 and the second region 22 in the microstructure of the hard polycrystalline compact 12. In such embodiments, it may be possible to identify and define regions within the polycrystalline compact 12, which have different average compositions of the metallic material 50 (FIG. 3) therein.

The first region 20 and the second region 22 may be sized and configured such that the hard polycrystalline material 16 exhibits desirable physical properties, such as wear-resistance, fracture toughness, and thermal stability, when the cutting element 10 is used to cut formation material. For example, the first region 20 and the second region 22 may be selectively sized and configured to enhance (e.g., optimize) one or more of a wear-resistance, a fracture toughness, and a thermal stability, of the hard polycrystalline material 16 when the cutting element 10 is used to cut formation material.

FIG. 3 is an enlarged view illustrating how a microstructure of the hard polycrystalline material 16 in the first region 20 and the second region 22 of the polycrystalline compact 12, of FIGS. 1 and 2, may appear under magnification. As shown therein, the polycrystalline compact 12 comprises a plurality of interspersed and inter-bonded grains of the hard polycrystalline material 16. In some embodiments, the inter-bonded grains of the hard polycrystalline material 16 may have a uni-modal grain size distribution. In other embodiments, however, these inter-bonded grains of the hard polycrystalline material 16 may have a multi-modal (e.g., bi-modal, tri-modal, etc.) grain size distribution, as shown in FIG. 3. For example, the hard polycrystalline material 16 may include a first plurality of grains 30 of hard material having a first average grain size, and at least a second plurality of grains 32 of hard material having a second average grain size that differs from the first average grain size of the first plurality of grains 30, as shown in FIG. 3. The second plurality of grains 32 may be smaller than the first plurality of grains 30. While FIG. 3 illustrates the second plurality of grains 32 as being smaller, on average, than the first plurality of grains 30, the drawings are not to scale and have been simplified for purposes of illustration. In some embodiments, the difference between the average sizes of the first plurality of grains 30 and the second plurality of grains 32 may be greater than or less than the difference in the average grain sizes illustrated in FIG. 3. In some embodiments, the second plurality of grains 32 may comprise nanograins having an average grain size of about five hundred nanometers (500 nm) or less.

The grains 30, 32 of hard material may be interspersed and inter-bonded to form the hard polycrystalline material 16. In other words, in embodiments in which the hard polycrystalline material 16 comprises polycrystalline diamond, the larger grains 30 and the smaller grains 32 may be mixed together and bonded directly to one another by inter-granular diamond-to-diamond bonds.

With continued reference to FIG. 3, as non-limiting examples, the first average grain size of the first plurality of grains 30 may be at least about five microns (5 μm), and the second average grain size of the second plurality of grains 32 may be about one micron (1 μm) or less. In some embodiments, the second average grain size of the second plurality of grains 32 may be about five hundred nanometers (500 nm) or less, about two hundred nanometers (200 nm) or less or even about one hundred fifty nanometers (150 nm) or less. In some embodiments, the first average grain size of the first plurality of grains 30 may be between about five microns (5 μm) and about forty microns (40 μm), and the second average grain size of the second plurality of grains 32 may be about five hundred nanometers (500 nm) or less (e.g., between about six nanometers (6 nm) and about one-hundred fifty nanometers (150 nm)). In some embodiments, the first average grain size of the first plurality of grains 30 may be at least about fifty (50) times greater, at least about one hundred (100) times greater, or even at least about one hundred fifty (150) times greater, than the second average grain size of the second plurality of grains 32.

The first plurality of grains 30 in the first region 20 of the hard polycrystalline material 16 and the second plurality of grains 32 in the second region 22 of the hard polycrystalline material 16 may have the same average grain size and grain size distribution. In additional embodiments, they may have different average grain sizes and/or grain size distributions.

As known in the art, the average grain size of grains within a microstructure may be determined by measuring grains of the microstructure under magnification. For example, a scanning electron microscope (SEM), a field emission scanning electron microscope (FESEM), or a transmission electron microscope (TEM) may be used to view or image a surface of a hard polycrystalline material 16 (e.g., a polished and etched surface of the hard polycrystalline material 16). Commercially available vision systems or image analysis software are often used with such microscopy tools, and these vision systems are capable of measuring the average grain size of grains within a microstructure.

In some embodiments, the grains 30, 32 of hard material may comprise between about eighty percent (80%) and about ninety-nine percent (99%) by volume of the polycrystalline compact 12. The metallic material 50 may comprise between about one percent (1%) and about twenty percent (20%) by volume of the polycrystalline compact 12. In some embodiments, the metallic material 50 may at least substantially occupy a remainder of the volume of the polycrystalline compact 12 that is not occupied by the grains 30, 32 of hard material.

With continued reference to FIG. 3, the metallic material 50 is disposed in interstitial spaces between the inter-bonded grains 30, 32 of hard material. As previously mentioned, at least a portion of the metallic material 50 comprises a metal alloy, the metal alloy comprising two or more elements. One element of the two or more elements of the metal alloy comprises one or more of cobalt, iron, and nickel. Another element of the two or more elements of the metal alloy comprises at least one of dysprosium, yttrium, terbium, gadolinium, germanium, samarium, neodymium, and praseodymium.

Such metal alloys may be formulated such that they have melting temperatures near or below the temperature of about seven hundred fifty degrees Celsius (750° C.), at and about which the hard polycrystalline material may degrade. For example, it is known that diamond may undergo a chemical breakdown or back-conversion to another allotrope of carbon or another carbon-based material at temperatures of about seven hundred fifty degrees Celsius (750° C.) in the presence of an iron, nickel, or cobalt metal catalyst material, as previously discussed herein.

Thus, by causing at least a portion of the metallic material 50 to comprise a metal alloy having such a composition having a melting temperature of about seven hundred fifty degrees Celsius (750° C.) or less, that portion of the metallic material 50 may be melted and removed from the polycrystalline compact 12 (either before or during use of the hard polycrystalline material 16 to cut or otherwise remove formation material in an earth-boring process) without detrimentally affecting the hard polycrystalline material 16 in any significant manner.

In some embodiments, at least about five weight percent (5 wt %) or more of the metal alloy may comprise one or more of dysprosium, yttrium, terbium, gadolinium, germanium, samarium, neodymium, and praseodymium. More particularly, at least about fifty weight percent (50 wt %) or more, or even about sixty weight percent (60 wt %) or more, of the metal alloy may comprise one or more of dysprosium, yttrium, terbium, gadolinium, germanium, samarium, neodymium, and praseodymium.

Each of the elements of dysprosium, yttrium, terbium, gadolinium, germanium, samarium, neodymium, and praseodymium is believed to form at least one eutectic composition with at least one of cobalt, iron, and nickel. In some embodiments, the metal alloy may comprise a near-eutectic composition. In some embodiments, the metal alloy may comprise a eutectic composition. Further, the eutectic composition may comprise a binary eutectic composition, a ternary eutectic composition, and a quaternary eutectic composition.

As non-limiting examples, Table 1 below lists binary eutectic compositions of cobalt and each of dysprosium, yttrium, terbium, gadolinium, germanium, samarium, neodymium, and praseodymium.

TABLE 1

| Rare Earth/ Lanthanide Element | Approximate Weight % | Left-Hand Compound | Right-Hand Compound | Melting Temperature ° C. |
|---|---|---|---|---|
| Dysprosium | 81 | $Co_2Dy$ | $Co_7Dy_{12}$ | 745 |
| Yttrium | 72 | $Co_5Y_8$ | $CoY_3$ | 738 |
| Terbium | 82.5 | $Co_2Tb$ | $Co_7Tb_{12}$ | 695 |
| Gadolinium | 81 | $Co_3Gd_4$ | $Co_7Gd_{12}$ | 660 |
| Germanium | 77 | $CoGe_2$ | Ge | 617 |
| Samarium | 82 | $Co_2Sm$ | $Co_4Sm_9$ | 575 |
| Neodymium | 81 | $Co_{1.7}Nd_2$ | $Co_3Nd_7$ | 566 |
| Praseodymium | 82 | $Co_{1.7}Pr_2$ | $Co_2Pr_5$ | 558 |

In Table 1 above, the Approximate Weight % in the second column is the approximate weight percentage of the respective rare earth or lanthanide element in the binary eutectic composition of cobalt and the respective rare earth or lanthanide element. The Left-Hand Compound is the compound on the left-hand side of the eutectic composition in the binary phase diagram for cobalt and the respective rare earth or lanthanide element, and the Right-Hand Compound is the compound on the right-hand side of the eutectic composition in the binary phase diagram for cobalt and the respective rare earth or lanthanide element. The Melting Temperatures provided in the fifth column of Table 1 are the approximate melting temperatures of the eutectic compositions of cobalt and the respective rare earth or lanthanide elements.

Thus, in some embodiments, the metal alloy may comprise a eutectic or near-eutectic composition of any of the following: cobalt and dysprosium, cobalt and yttrium, cobalt and terbium, cobalt and gadolinium, cobalt and germanium, cobalt and samarium, cobalt and neodymium, and cobalt and praseodymium.

In additional embodiments, the metal alloy may comprise a eutectic or near-eutectic composition of any of the following: iron and dysprosium, iron and yttrium, iron and terbium, iron and gadolinium, iron and germanium, iron and samarium, iron and neodymium, and iron and praseodymium.

In yet further embodiments, the metal alloy may comprise a eutectic or near-eutectic composition of any of the following: nickel and dysprosium, nickel and yttrium, nickel and terbium, nickel and gadolinium, nickel and germanium, nickel and samarium, nickel and neodymium, and nickel and praseodymium.

The metal alloy may have a melting temperature of about seven hundred fifty degrees Celsius (750° C.) or less, or even about six hundred fifty degrees Celsius (650° C.) or less. In some embodiments, the metal alloy may have a melting temperature of about three hundred degrees Celsius (300° C.) or more, or even about five hundred fifty degrees Celsius (550° C.) or more. In some embodiments, the metal alloy may have a melting temperature of between about five hundred fifty degrees Celsius (550° C.) and about six hundred fifty degrees Celsius (650° C.).

In some embodiments, a portion of the interstitial spaces between the inter-bonded grains 30, 32 of hard material in the second region 22 may be at least substantially free of the metallic material 50. Such interstitial spaces between the grains 30, 32 may comprise voids filled with gas (e.g., air).

The interstitial spaces between the grains 30, 32 of hard material primarily comprise an open, interconnected network of spatial regions within the microstructure of the hard polycrystalline material 16. A relatively small portion of the interstitial spaces may comprise closed, isolated spatial regions within the microstructure. When it is said that a portion of the interstitial spaces between the inter-bonded grains 30, 32 of hard material in the second region 22 may be at least substantially free of the metallic material 50, it is meant that metallic material 50 is removed from the open, interconnected network of spatial regions between the grains 30, 32 within the microstructure in that portion, although a relatively small amount of metallic material 50 may remain in closed, isolated spatial regions between the grains 30, 32, as it may be difficult or impossible to remove volumes of metallic material 50 within such closed, isolated spatial regions.

In some embodiments, substantially all of the metallic material 50 may comprise a metal alloy comprising one or more of the rare earth or lanthanide elements listed in Table 1, as described hereinabove. In yet further embodiments, only a portion of the metallic material 50 may comprise a metal alloy comprising one or more of the rare earth or lanthanide elements listed in Table 1. In such embodiments, another portion of the metallic material 50 may comprise a standard iron-, cobalt-, or nickel-based metal catalyst material such as those currently known in the art. In other words, in some embodiments, at least a portion of the metallic material 50 may comprise a catalyst material used for catalyzing the formation of inter-granular bonds between the grains 30, 32 of the hard polycrystalline material 16. In embodiments in which the hard polycrystalline material 16 comprises polycrystalline diamond, at least a portion of the metallic material 50 may comprise a Group VIIIA element (e.g., iron, cobalt, or nickel) or an alloy or mixture thereof.

Referring again to FIGS. 1 and 2, the polycrystalline compact 12 has a generally flat, cylindrical, and disc-shaped configuration. An exposed, planar major surface 26 of the first region 20 of the polycrystalline compact 12 defines a front cutting face of the cutting element 10. One or more lateral side surfaces of the polycrystalline compact 12 extend from the major surface 26 of the polycrystalline compact 12 to the substrate 14 on a lateral side 28 of the cutting element 10. In the embodiment shown in FIGS. 1 and 2, each of the first region 20 and the second region 22 of the hard polycrystalline material 16 comprises a generally planar layer that extends to and is exposed at the lateral side 28 of the polycrystalline compact 12. For example, a lateral side surface of the first region 20 of the hard polycrystalline material 16 may have a generally cylindrical shape, and a lateral side surface of the second region 22 of the hard polycrystalline material 16 may have an angled, frustoconical shape and may define or include a chamfer surface of the cutting element 10.

Figure 4A:
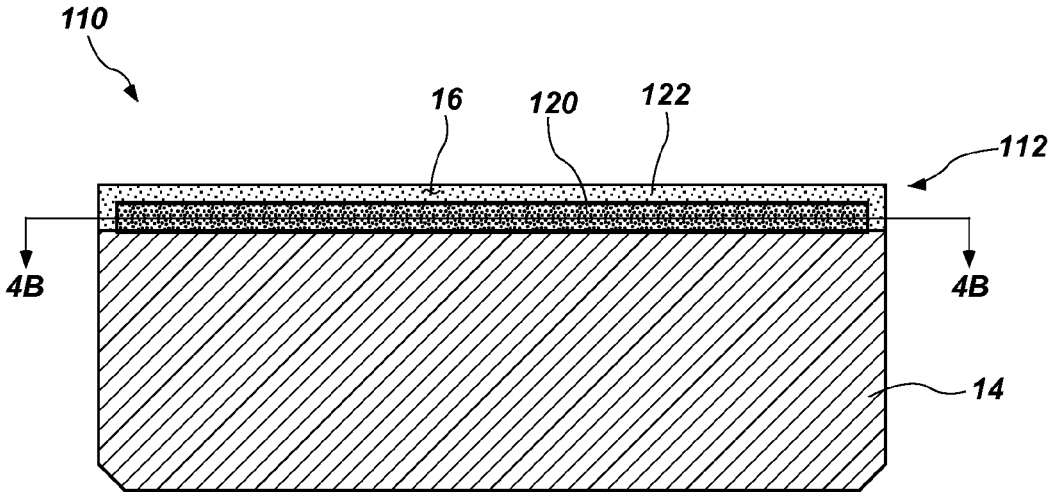
FIG. 4A is a cross-sectional side view like that of FIG. 2 and illustrates another embodiment of a cutting element comprising a polycrystalline compact having two regions with different interstitial materials therein.
Figure 4B:
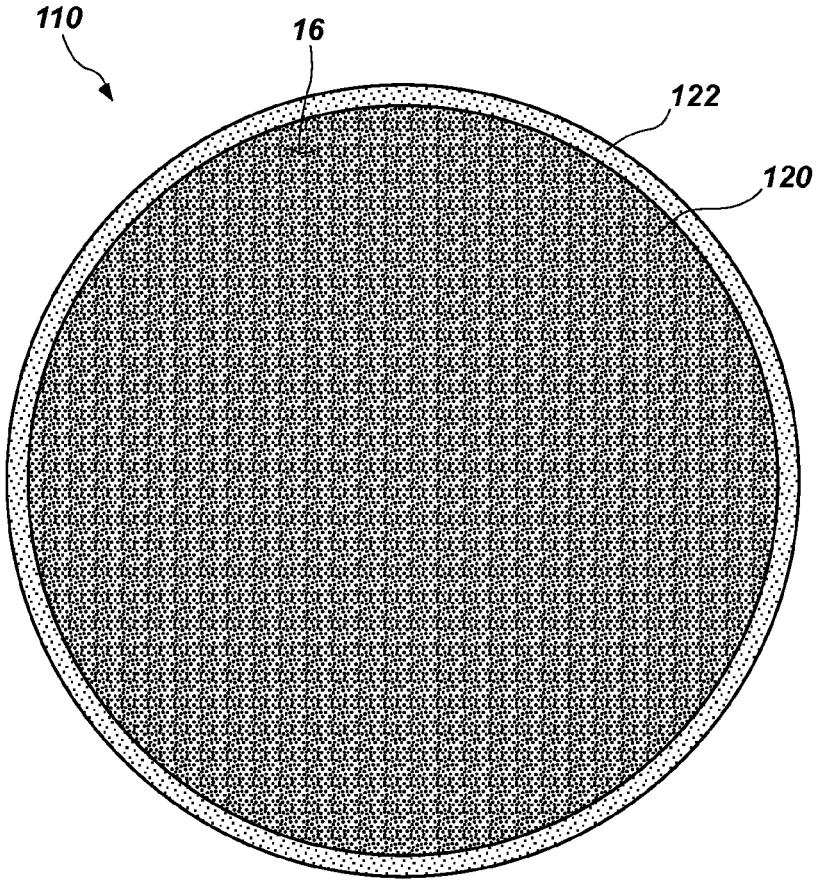
FIG. 4B is a cross-sectional view of the cutting element shown in FIG. 4A taken along the section line 4B-4B shown therein.

Embodiments of cutting elements 10 and polycrystalline compacts 12 of the present disclosure may have shapes and configurations other than those shown in FIGS. 1 and 2. For example, an additional embodiment of a cutting element 110 of the present disclosure is shown in FIGS. 4A and 4B. The cutting element 110 is similar to the cutting element 10 in many aspects, and includes a polycrystalline compact 112 that is bonded to a cutting element substrate 14. The polycrystalline compact 112 comprises a table or layer of hard polycrystalline material 16 as previously described that has been provided on (e.g., formed on or secured to) a surface of a supporting cutting element substrate 14. The polycrystalline compact 112 includes a first region 120 and a second region 122, as shown in FIGS. 4A and 4B. The first region 120 and the second region 122 may have a composition and microstructure as described above in relation to the first region 20 and the second region 22 with reference to FIGS. 1 through 3.

In the embodiment of FIGS. 4A and 4B, however, the first region 120 does not extend to, and is not exposed at, the lateral side of the cutting element 110. The second region 122 extends over the major planar surface of the first region 120 on a side thereof opposite the substrate 14, and also extends over and around the lateral side surface of the first region 120 to the substrate 14. In this configuration, a portion of the second region 122 has an annular shape that extends circumferentially around a cylindrically shaped lateral side surface of the first region 120. It is contemplated that the first region 120 and the second region 122 may have various different shapes and configurations, and one or more portions of the second region 122 may extend through or past the first region 120 to a substrate 14 in a number of different configurations.

Additional embodiments of the disclosure include methods of manufacturing polycrystalline compacts and cutting elements, such as the polycrystalline compacts and cutting elements described hereinabove. In general, the methods include forming an unsintered compact preform comprising a plurality of grains of hard material. The unsintered compact preform then may be sintered in the presence of a catalyst material to form a hard polycrystalline material comprising inter-bonded grains of hard material formed by bonding together the plurality of grains of hard material present in the unsintered compact preform. The catalyst material is used to catalyze the formation of the inter-granular bonds between the grains of hard material. A metal alloy, as described hereinabove, is provided in at least some interstitial spaces between the inter-bonded grains of hard material. For example, the metal alloy may be formulated to comprise at least two elements. A first element of the at least two elements may be selected from the group consisting of cobalt, iron, and nickel, and a second element of the at least two elements may be selected from the group consisting of dysprosium, yttrium, terbium, gadolinium, germanium, samarium, neodymium, and praseodymium.

As previously discussed herein, the plurality of grains of hard material may be selected to comprise a hard material such as diamond or cubic boron nitride. In some embodiments, the metal alloy may be formulated to comprise a near-eutectic composition, and may be formulated to comprise a eutectic composition. The eutectic composition may comprise, for example, one of a binary eutectic composition, a ternary eutectic composition, and a quaternary eutectic composition.

As non-limiting example embodiments, the metal alloy may be formulated to comprise at least one of a near-eutectic or eutectic composition of cobalt and dysprosium, a near-eutectic or eutectic composition of cobalt and yttrium, a near-eutectic or eutectic composition of cobalt and terbium, a near-eutectic or eutectic composition of cobalt and gadolinium, a near-eutectic or eutectic composition of cobalt and germanium, a near-eutectic or eutectic composition of cobalt and samarium, a near-eutectic or eutectic composition of cobalt and neodymium, a near-eutectic or eutectic composition of cobalt and praseodymium, a near-eutectic or eutectic composition of iron and dysprosium, a near-eutectic or eutectic composition of iron and yttrium, a near-eutectic or eutectic composition of iron and terbium, a near-eutectic or eutectic composition of iron and gadolinium, a near-eutectic or eutectic composition of iron and germanium, a near-eutectic or eutectic composition of iron and samarium, a near-eutectic or eutectic composition of iron and neodymium, a near-eutectic or eutectic composition of iron and praseodymium, a near-eutectic or eutectic composition of nickel and dysprosium, a near-eutectic or eutectic composition of nickel and yttrium, a near-eutectic or eutectic composition of nickel and terbium, a near-eutectic or eutectic composition of nickel and gadolinium, a near-eutectic or eutectic composition of nickel and germanium, a near-eutectic or eutectic composition of nickel and samarium, a near-eutectic or eutectic composition of nickel and neodymium, and a near-eutectic or eutectic composition of nickel and praseodymium.

Additionally, the metal alloy may be formulated to have a melting temperature of about seven hundred fifty degrees Celsius (750° C.) or less. For example, the metal alloy may be formulated to have a melting temperature of about six hundred fifty degrees Celsius (650° C.) or less, and may be formulated to have a melting temperature of between about five hundred fifty degrees Celsius (550° C.) and about six hundred fifty degrees Celsius (650° C.) in some embodiments.

Further, as discussed above, the metal alloy may be provided in a first region of the polycrystalline material, and a second region of the polycrystalline material may be formed to be at least substantially free of the metal alloy.

As discussed in further detail below, the metal alloy may be provided in at least some interstitial spaces between the inter-bonded grains 30,32 of hard material during the sintering process used to form the hard polycrystalline material 16, or after the sintering process used to form the hard polycrystalline material 16.

Figure 5:
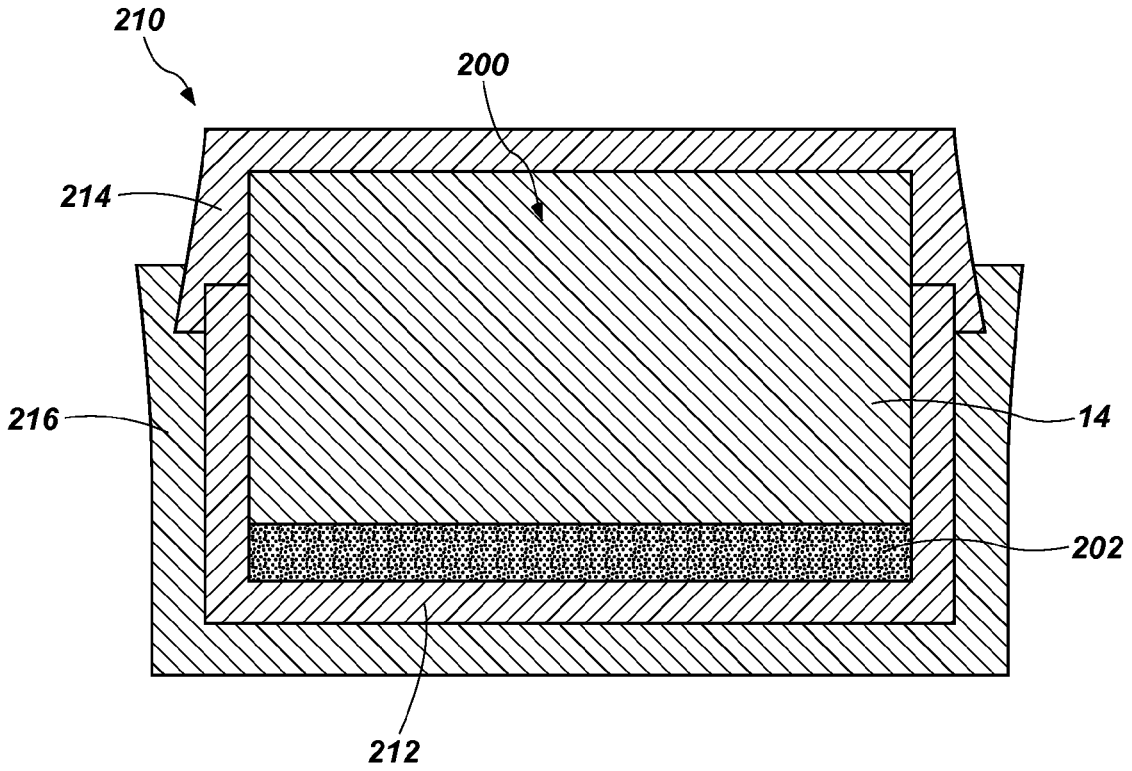
FIG. 5 is simplified cross-sectional side view of an assembly that may be employed in embodiments of methods of the disclosure, which may be used to fabricate cutting elements as described herein, such as the cutting element shown in FIGS. 1 and 2.

FIG. 5 illustrates an unsintered compact preform 200 within a container 210 prior to a sintering process. The unsintered compact preform 200 includes a particulate matter 202. The unsintered compact preform 200 optionally may be further provided with a cutting element substrate 14, as shown in FIG. 5. The particulate matter 202 is used to form the hard polycrystalline material 16 of the polycrystalline compact 12 of FIGS. 1 and 2.

The container 210 may include one or more generally cup-shaped members, such as a cup-shaped member 212, a cup-shaped member 214, and a cup-shaped member 216, which may be assembled and swaged and/or welded together to form the container 210. The particulate matter 202 and the optional cutting element substrate 14 may be disposed within the inner cup-shaped member 212, as shown in FIG. 5, which has a circular end wall and a generally cylindrical lateral side wall extending perpendicularly from the circular end wall, such that the inner cup-shaped member 212 is generally cylindrical and includes a first closed end and a second, opposite open end.

The particulate matter 202 may be provided adjacent a surface of a substrate 14. The particulate matter 202 includes crystals or grains of hard material, such as diamond. The diamond grains in the particulate matter 202 may have a uni-modal or a multi-modal (e.g., bi-modal, tri-modal, etc.) grain size distribution. For example, the diamond grains in the particulate matter 202 may include the first plurality of grains 30 of hard material having a first average grain size, and the second plurality of grains 32 of hard material having a second average grain size that differs from the first average grain size of the first plurality of grains 30, in an unbonded state. The unbonded first plurality of grains 30 and second plurality of grains 32 may have relative and actual sizes as previously described with reference to FIG. 3, although it is noted that some degree of grain growth and/or shrinkage may occur during the sintering process used to form the hard polycrystalline material 16. For example, the first plurality of grains 30 may undergo some level of grain growth during the sintering process, and the second plurality of grains 32 may undergo some level of grain shrinkage during the sintering process. In other words, the first plurality of grains 30 may grow at the expense of the second plurality of grains 32 during the sintering process.

To catalyze the formation of inter-granular bonds between the diamond grains in the particulate matter 202 during an HTHP sintering process, the diamond grains in the particulate matter 202 may be physically exposed to catalyst material during the sintering process. In other words, particles of catalyst material may be provided in the particulate matter 202 prior to commencing the HTHP process, or catalyst material may be allowed or caused to migrate into the particulate matter 202 from one or more sources of catalyst material during the HTHP process. For example, the particulate matter 202 optionally may include particles comprising a catalyst material (such as, for example, particles of cobalt, iron, nickel, or an alloy and mixture thereof). In additional embodiments, if the substrate 14 includes a catalyst material (such as the cobalt in cobalt-cemented tungsten carbide), the catalyst material may be swept from the surface of the substrate 14 into the particulate matter 202 during sintering, and catalyze the formation of inter-granular diamond bonds between the diamond grains in the particulate matter 202. In such instances, it may not be necessary or desirable to include particles of catalyst material in the particulate matter 202.

If particles of catalyst material are incorporated into the particulate matter 202 prior to sintering, such particles of catalyst material may have an average particle size of between about ten nanometers (10 nm) and about one micron (1 μm). Further, it may be desirable to select the average particle size of the catalyst particles such that a ratio of the average particle size of the catalyst particles to the average grain size of the grains of hard material with which the particles are mixed is within the range of from about 1:10 to about 1:1000, or even within the range from about 1:100 to about 1:1000, as disclosed in U.S. Patent Application Publication No. US 2010/0186304 A1, which published Jul. 29, 2010 in the name of Burgess et al., and is incorporated herein in its entirety by this reference. Particles of catalyst material may be mixed with the grains of hard material using techniques known in the art, such as standard milling techniques, sol-gel techniques, by forming and mixing a slurry that includes the particles of catalyst material and the grains of hard material in a liquid solvent, and subsequently drying the slurry, etc.

In some embodiments, a plurality of particles each comprising a metal alloy that includes a rare earth or lanthanide metal element as described hereinabove may also be provided in the particulate matter 202. In other words, the particulate matter 202 may further include particles comprising metal alloy that includes two or more elements, wherein a first element of the at least two elements is one or more of cobalt, iron, and nickel, and a second element of the at least two elements is one or more of dysprosium, yttrium, terbium, gadolinium, germanium, samarium, neodymium, and praseodymium. Such metal alloy particles may have an average particle size of between about ten nanometers (10 nm) and about one micron (1 μm), and may be mixed with the grains of hard material using techniques known in the art, such as standard milling techniques, sol-gel techniques, by forming and mixing a slurry that includes the metal alloy particles and the grains of hard material in a liquid solvent, and subsequently drying the slurry, etc.

After providing the particulate matter 202 and the optional substrate 14 within the container 210 as shown in FIG. 5, the assembly optionally may be subjected to a cold pressing process to compact the particulate matter 202 and the optional substrate 14 in the container 210.

The resulting assembly then may be sintered in an HTHP process in accordance with procedures known in the art to form a cutting element 10 having a polycrystalline compact 12 comprising a hard polycrystalline material 16.

Although the exact operating parameters of HTHP processes will vary depending on the particular compositions and quantities of the various materials being sintered, the pressures in the heated press may be greater than about five gigapascals (5.0 GPa) and the temperatures may be greater than about thirteen hundred degrees Celsius (1,300° C.). In some embodiments, the temperatures in the heated press may be greater than about fifteen hundred degrees Celsius (1,500° C.). Additionally, the pressures in the heated press may be greater than about 6.5 GPa (e.g., about 6.7 GPa) in some embodiments. Furthermore, the materials being sintered may be held at such temperatures and pressures for between about thirty seconds (30 sec) and about twenty minutes (20 min).

In embodiments in which the metal alloy is not provided within the hard polycrystalline material 16 during the sintering process used to form the hard polycrystalline material 16, the metal alloy may be provided within the hard polycrystalline material 16 after the sintering process. For example, the hard polycrystalline material 16 may be formed using techniques known in the art, such that the metallic material 50 in the interstitial spaces between the inter-bonded grains of hard polycrystalline material 16 is at least substantially comprised of cobalt, iron, nickel, or an alloy or mixture thereof, but does not include a metal alloy comprising one or more of dysprosium, yttrium, terbium, gadolinium, germanium, samarium, neodymium, and praseodymium as described herein. In such embodiments, the polycrystalline compact 12 may be subjected to an alloying process after forming the hard polycrystalline material 16 in the sintering process, in which the composition of the metallic material 50 within at least a portion of the polycrystalline compact 12 is altered to form the metal alloy comprising one or more of dysprosium, yttrium, terbium, gadolinium, germanium, samarium, neodymium, and praseodymium as described herein.

Figure 6:
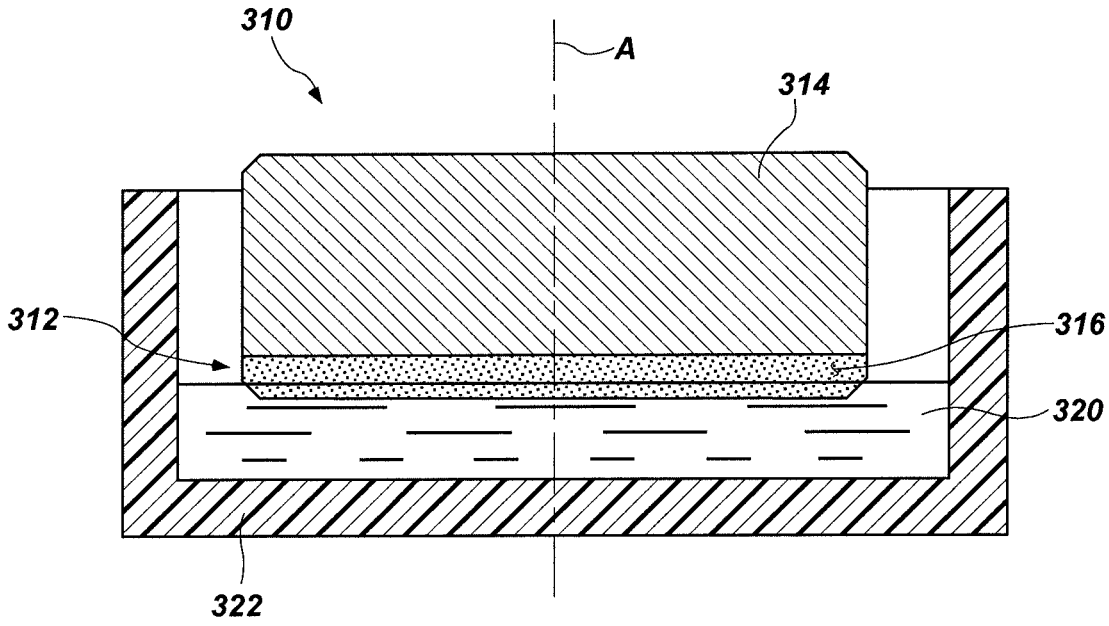
FIG. 6 is a simplified cross-sectional side view of a cutting element having a polycrystalline compact partially immersed in a molten metallic material, and is used to describe embodiments of methods of the disclosure that may be used to fabricate cutting elements, such as the cutting element shown in FIGS. 1 and 2.

For example, FIG. 6 illustrates a cutting element 310 that includes a polycrystalline compact 312 on a cutting element substrate 314 formed using processes known in the art. The polycrystalline compact 312 includes polycrystalline diamond material 316, and includes a cobalt-based metal catalyst material in the interstitial spaces between the inter-bonded diamond grains in the polycrystalline diamond material 316. A cutting element 10 as described hereinabove with reference to FIGS. 1 through 3 may be formed by providing a metal alloy comprising one or more of dysprosium, yttrium, terbium, gadolinium, germanium, samarium, neodymium, and praseodymium as described herein within a portion of the polycrystalline diamond material 316.

By way of example and not limitation, a molten metal 320 may be provided within a crucible 322 or other container. The molten metal 320 may comprise one or more of dysprosium, yttrium, terbium, gadolinium, germanium, samarium, neodymium, and praseodymium. In some embodiments, the molten metal 320 may comprise one of dysprosium, yttrium, terbium, gadolinium, germanium, samarium, neodymium, and praseodymium in commercially pure form. In other embodiments, the molten metal 320 may comprise an alloy based on one or more of dysprosium, yttrium, terbium, gadolinium, germanium, samarium, neodymium, and praseodymium. Further, in some embodiments, the molten metal 320 may comprise a near-eutectic or eutectic alloy of one or more of cobalt, iron, and nickel, and one or more of dysprosium, yttrium, terbium, gadolinium, germanium, samarium, neodymium, and praseodymium, as previously described herein. Optionally, the molten metal 320 may comprise such a near-eutectic alloy that is lean in the one or more iron group elements (cobalt, iron, and nickel). In other words, the atomic percentage of the one or more iron group elements may be less than the atomic percentage of the one or more iron group elements at the eutectic composition. Further, the molten metal 320 may have a melting point within the ranges previously described herein.

The metal 320 may be heated in the crucible 322 in a furnace to a temperature of about seven hundred fifty degrees Celsius (750° C.) or less, and may be heated using a resistive or inductive heating element, for example. Optionally, the molten metal 320 may be heated in the furnace in an inert atmosphere to avoid any undesirable chemical reactions (e.g., oxidation) that might otherwise occur at elevated temperatures.

At least a portion of the polycrystalline compact 312 then may be submerged in the molten metal 320, as shown in FIG. 6. The molten metal 320 may remain in contact with the polycrystalline compact 312 for a time period of between a few seconds to several hours to alloy the elements in the molten metal 320 to diffuse into the interstitial spaces between the inter-bonded diamond grains within the polycrystalline compact 312. The molten metal 320 may interact with (e.g., mix or alloy with) the cobalt-, iron-, or nickel-based catalyst material in the interstitial spaces between the inter-bonded diamond grains within the polycrystalline compact 312 in such a manner as to form or otherwise provide a metal alloy as described herein within the interstitial spaces between the inter-bonded diamond grains in at least a portion of the polycrystalline compact 312.

Optionally, the cutting element 310 may be rotated about a central axis A of the cutting element 310 while the polycrystalline compact 312 remains immersed in the molten metal 320. In some embodiments, a magnetic stirring device and/or an electromagnetic field source may be positioned outside the crucible 322 and used to provide a stirring or agitating magnetic field, which, due to the magnetic nature of at least some of the elements within the molten metal 320 and the polycrystalline compact 312, may enhance the rate at which the molten metal 320 interacts with the cobalt-, iron-, or nickel-based catalyst material in the interstitial spaces between the inter-bonded diamond grains within the polycrystalline compact 312.

After removing the cutting element 310 from the molten metal 320, the molten metal 320 within the interstitial spaces between the inter-bonded diamond grains in the polycrystalline material 316 may be allowed to cool and solidify.

In the embodiment of FIG. 6, the cutting element 310 and the molten metal 320 are oriented and positioned such that, as the polycrystalline compact 312 of the cutting element 310 is removed from the molten metal 320, the surface tension of the molten metal 320 and/or the force of gravity may cause at least a portion of molten metal 320 within the interstitial spaces between the inter-bonded diamond grains within the polycrystalline compact 312 to be pulled out from some of the interstitial spaces near the major surface of the polycrystalline compact 312. In such embodiments, a portion of the interstitial spaces between the inter-bonded diamond grains of hard material within the polycrystalline compact 312 near the surface thereof may be at least substantially free of metallic material 50 (FIG. 3), and may comprise voids that are simply filled with air.

Figure 7:
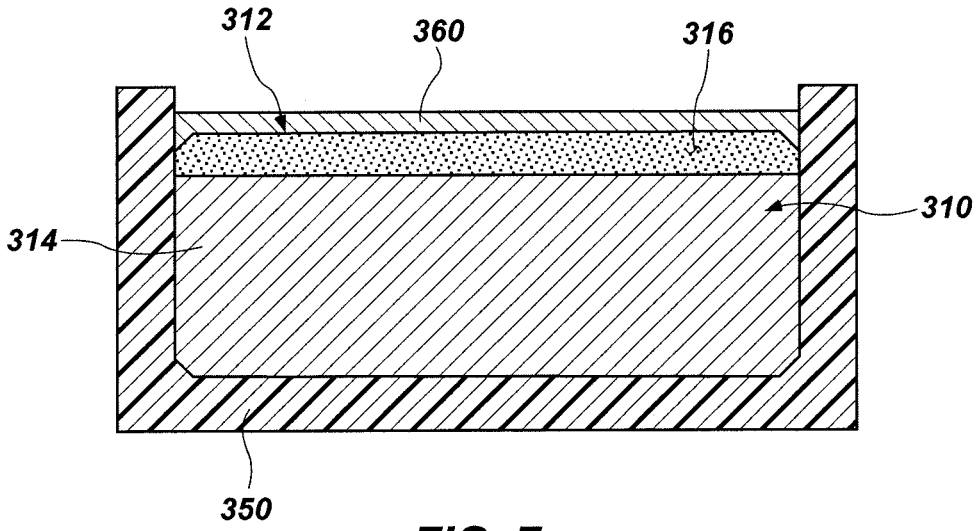
FIG. 7 is a simplified cross-sectional side view of a metallic material disposed on a polycrystalline compact of a cutting element, and is used to describe additional embodiments of methods of the disclosure that may be used to fabricate cutting elements, such as the cutting element shown in FIGS. 1 and 2.

FIG. 7 illustrates another embodiment of a method that may be used to provide a metal alloy comprising one or more of dysprosium, yttrium, terbium, gadolinium, germanium, samarium, neodymium, and praseodymium as described herein within the interstitial spaces in a hard polycrystalline material. A polycrystalline compact 312 as previously described with reference to FIG. 6 may be provided in a crucible 350. The polycrystalline compact 312 may abut against the lateral side surfaces of the cutting element 310, as shown in FIG. 7, such that material cannot infiltrate into any space between the cutting element 310 and the crucible 350. In this configuration, one or more surfaces of the polycrystalline compact 312 may be exposed within the crucible 350.

A metal 360 in solid form (e.g., a solid powder, a solid film, etc.) may be provided within a crucible 350 over the exposed surfaces of the polycrystalline compact 312. The metal 360 may comprise one or more of dysprosium, yttrium, terbium, gadolinium, germanium, samarium, neodymium, and praseodymium. In some embodiments, the metal 360 may comprise one of dysprosium, yttrium, terbium, gadolinium, germanium, samarium, neodymium, and praseodymium in commercially pure form. In other embodiments, the metal 360 may comprise an alloy based on one or more of dysprosium, yttrium, terbium, gadolinium, germanium, samarium, neodymium, and praseodymium. Further, in some embodiments, the metal 360 may comprise a near-eutectic or eutectic alloy of one or more of cobalt, iron, and nickel, and one or more of dysprosium, yttrium, terbium, gadolinium, germanium, samarium, neodymium, and praseodymium, as previously described herein. Optionally, the metal 360 may comprise such a near-eutectic alloy that is lean in the one or more iron group elements (cobalt, iron, and nickel). In other words, the atomic percentage of the one or more iron group elements may be less than the atomic percentage of the one or more iron group elements at the eutectic composition. Further, the metal 360 may have a melting point within the ranges previously described herein.

The metal 360 may be heated in the crucible 350 in a furnace in a manner similar to that described in relation to FIG. 6. The metal 360 may be heated to a temperature of about seven hundred fifty degrees Celsius (750° C.) or less. In some embodiments, the metal 360 may melt within the crucible 350. In other embodiments, the metal 360 may remain in solid form within the crucible 350. The metal 360 may remain in contact with the polycrystalline compact 312 for a time period of between a few seconds to several hours to alloy the elements in the metal 360 to diffuse into the interstitial spaces between the inter-bonded diamond grains within the polycrystalline compact 312. The metal 360 may interact with (e.g., mix or alloy) the cobalt-, iron-, or nickel-based catalyst material in the interstitial spaces between the inter-bonded diamond grains within the polycrystalline compact 312 in such a manner as to form or otherwise provide a metal alloy as described herein within the interstitial spaces between the inter-bonded diamond grains in at least a portion of the polycrystalline compact 312.

After providing the metal alloy within at least a portion of the interstitial spaces between the inter-bonded diamond grains in at least a portion of the polycrystalline compact 312, the cutting element 310 may be removed from the crucible 350 and any excess metal 360 disposed on the polycrystalline compact 312 may be removed therefrom.

The metal alloys described herein, which are provided in the interstitial spaces between the inter-bonded grains of hard material in at least a portion of the polycrystalline compact, may exhibit a melting temperature at or below a temperature at which the polycrystalline hard material will decompose or otherwise degrade. As such, the metal alloys optionally may be removed from the polycrystalline compact prior to using the polycrystalline compact to remove formation material in an earth-boring process by heating the polycrystalline compact to melt the metal alloy, and draining or drawing the molten metal alloy out from the polycrystalline material. In other embodiments, the metal alloys may be left in place within the polycrystalline compact during use of the polycrystalline compact in removing formation material in an earth-boring process. In such an earth-boring process, heat generated by friction between the polycrystalline compact and the formation material in the earth-boring process may heat and melt the metal alloy in situ within the polycrystalline compact, and the molten metal alloy may be removed from the polycrystalline compact during the earth-boring process. Thus, embodiments of polycrystalline compacts of the present invention may be relatively less susceptible to thermal degradation and/or decomposition compared to at least some polycrystalline compacts previously known in the art.

Figure 8:
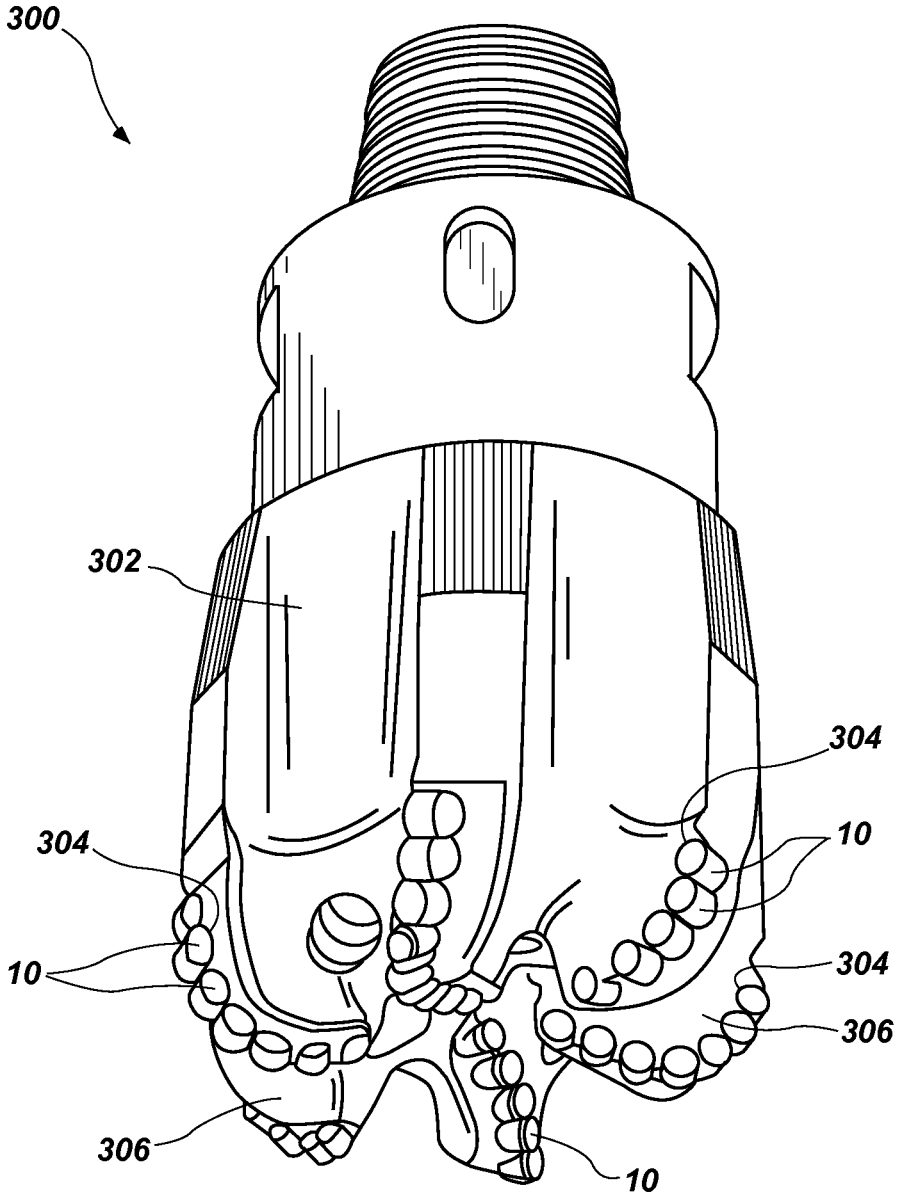
FIG. 8 is a perspective view of an embodiment of a fixed-cutter earth-boring rotary drill bit that includes a plurality of polycrystalline compacts like that shown in FIGS. 1 and 2.

Embodiments of polycrystalline compacts and cutting elements of the disclosure, such as the cutting elements 10 and polycrystalline compacts 12 described above with reference to FIGS. 1 through 3, may be formed and secured to earth-boring tools for use in forming wellbores in subterranean formations. As a non-limiting example, FIG. 8 illustrates a fixed-cutter type earth-boring rotary drill bit 300 that includes a plurality of cutting elements 10 as previously described herein. The rotary drill bit 300 includes a bit body 302, and the cutting elements 10 are bonded to the bit body 302. The cutting elements 10 may be brazed (or otherwise secured) within pockets 304 formed in the outer surface of each of a plurality of blades 306 of the bit body 302.

Cutting elements and polycrystalline compacts as described herein may be bonded to and used on other types of earth-boring tools, including, for example, roller cone drill bits, percussion bits, core bits, eccentric bits, bicenter bits, reamers, expandable reamers, mills, hybrid bits, and other drilling bits and tools known in the art.

The foregoing description is directed to particular embodiments for the purpose of illustration and explanation. It will be apparent, however, to one skilled in the art that many modifications and changes to the embodiments set forth above are possible without departing from the scope of the embodiments disclosed herein as hereinafter claimed, including legal equivalents. It is intended that the following claims be interpreted to embrace all such modifications and changes.

What is claimed is:

1. A polycrystalline compact, comprising:

a polycrystalline material comprising a plurality of inter-bonded grains of hard material; and a metallic material disposed in interstitial spaces between the inter-bonded grains of hard material, at least a portion of the metallic material comprising a metal alloy having a melting temperature of about seven hundred fifty degrees Celsius (750° C.) or less, the metal alloy comprising two or more elements, a first element of the two or more elements selected from the group consisting of cobalt, iron, and nickel, a second element of the two or more elements selected from the group consisting of dysprosium, yttrium, terbium, gadolinium, germanium, samarium, neodymium, and praseodymium.

2. The polycrystalline compact of claim 1, wherein the second element comprises at least about five weight percent (5 wt %) or more of the metal alloy.

3. The polycrystalline compact of claim 1, wherein the metal alloy comprises a near-eutectic composition.

4. The polycrystalline compact of claim 3, wherein the metal alloy is a eutectic composition.

5. The polycrystalline compact of claim 4, wherein the metal alloy is selected from the group consisting of a binary eutectic composition, a ternary eutectic composition, and a quaternary eutectic composition.

6. The polycrystalline compact of claim 3, wherein the near-eutectic composition is selected from the group consisting of a near-eutectic composition of cobalt and dysprosium, a near-eutectic composition of cobalt and yttrium, a near-eutectic composition of cobalt and terbium, a near-eutectic composition of cobalt and gadolinium, a near-eutectic composition of cobalt and germanium, a near-eutectic composition of cobalt and samarium, a near-eutectic composition of cobalt and neodymium, and a near-eutectic composition of cobalt and praseodymium.

7. The polycrystalline compact of claim 3, wherein the near-eutectic composition is selected from the group consisting of a near-eutectic composition of iron and dysprosium, a near-eutectic composition of iron and yttrium, a near-eutectic composition of iron and terbium, a near-eutectic composition of iron and gadolinium, a near-eutectic composition of iron and germanium, a near-eutectic composition of iron and samarium, a near-eutectic composition of iron and neodymium, and a near-eutectic composition of iron and praseodymium.

8. The polycrystalline compact of claim 3, wherein the near-eutectic composition is selected from the group consisting of a near-eutectic composition of nickel and dysprosium, a near-eutectic composition of nickel and yttrium, a near-eutectic composition of nickel and terbium, a near-eutectic composition of nickel and gadolinium, a near-eutectic composition of nickel and germanium, a near-eutectic composition of nickel and samarium, a near-eutectic composition of nickel and neodymium, and a near-eutectic composition of nickel and praseodymium.

9. The polycrystalline compact of claim 1, wherein the metal alloy has a melting temperature of about three hundred degrees Celsius (300° C.) or more.

10. The polycrystalline compact of claim 9, wherein the metal alloy has a melting temperature of about six hundred fifty degrees Celsius (650° C.) or less.

11. The polycrystalline compact of claim 10, wherein the metal alloy has a melting temperature of between about five hundred fifty degrees Celsius (550° C.) and about six hundred fifty degrees Celsius (650° C.).

12. The polycrystalline compact of claim 1, wherein the polycrystalline material comprises between about eighty percent by volume (80 vol %) and about ninety-nine percent by volume (99 vol %) of the polycrystalline compact.

13. The polycrystalline compact of claim 10, wherein the metallic material comprises between about one percent by volume (1 vol %) and about twenty percent by volume (20 vol %) of the polycrystalline compact.

14. The polycrystalline compact of claim 1, wherein the polycrystalline material comprises:

a first region, the metal alloy having a melting temperature of about seven hundred fifty degrees Celsius (750° C.) or less disposed in the first region of the polycrystalline material; and a second region, the metal alloy having a melting temperature of about seven hundred fifty degrees Celsius (750° C.) or less not disposed in the second region of the polycrystalline material.

15. The polycrystalline compact of claim 1, wherein the metallic material is not disposed in a portion of the interstitial spaces between the inter-bonded grains of hard material, the portion of the interstitial spaces between the inter-bonded grains of hard material comprising voids between the inter-bonded grains of hard material.

16. The polycrystalline compact of claim 1, wherein the hard material comprises diamond.

17. A polycrystalline compact, comprising:

a polycrystalline material comprising a plurality of inter-bonded grains of hard material; and a metallic material disposed in interstitial spaces between the inter-bonded grains of hard material, at least a portion of the metallic material comprising a metal alloy having a melting temperature of about seven hundred fifty degrees Celsius (750° C.) or less, the metal alloy comprising a near-eutectic composition of at least two elements, a first element of the at least two elements selected from the group consisting of cobalt, iron, and nickel, a second element of the at least two elements selected from the group consisting of dysprosium, yttrium, terbium, gadolinium, germanium, samarium, neodymium, and praseodymium.

18. The polycrystalline compact of claim 17, wherein the metal alloy is a eutectic composition.

19. A cutting element, comprising:

a cutting element substrate; and a polycrystalline compact bonded to the cutting element substrate, the polycrystalline compact comprising:

a polycrystalline material comprising a plurality of inter-bonded grains of hard material; and a metallic material disposed in interstitial spaces between the inter-bonded grains of hard material, at least a portion of the metallic material comprising a metal alloy having a melting temperature of about seven hundred fifty degrees Celsius (750° C.) or less, the metal alloy comprising two or more elements, a first element of the two or more elements selected from the group consisting of cobalt, iron, and nickel, a second element of the two or more elements selected from the group consisting of dysprosium, yttrium, terbium, gadolinium, germanium, samarium, neodymium, and praseodymium.

20. The cutting element of claim 19, wherein the metal alloy comprises a near-eutectic composition.

21. The cutting element of claim 20, wherein the hard material comprises diamond.

22. The cutting element of claim 21, wherein the metal alloy has a melting temperature of between about five hundred fifty degrees Celsius (550° C.) and about six hundred fifty degrees Celsius (650° C.).

23. A cutting element, comprising:

a cutting element substrate; and a polycrystalline compact bonded to the cutting element substrate, the polycrystalline compact comprising:

a polycrystalline material comprising a plurality of inter-bonded grains of hard material; and a metallic material disposed in interstitial spaces between the inter-bonded grains of hard material, at least a portion of the metallic material comprising a metal alloy having a melting temperature of about seven hundred fifty degrees Celsius (750° C.) or less, the metal alloy comprising a near-eutectic composition of at least two elements, a first element of the at least two elements selected from the group consisting of cobalt, iron, and nickel, a second element of the at least two elements selected from the group consisting of dysprosium, yttrium, terbium, gadolinium, germanium, samarium, neodymium, and praseodymium.

24. The cutting element of claim 23, wherein the metal alloy is a eutectic composition.

25. An earth-boring tool, comprising:

a tool body; and at least one cutting element attached to the tool body, the at least one cutting element comprising a polycrystalline compact comprising:

a polycrystalline material comprising a plurality of inter-bonded grains of hard material; and a metallic material disposed in interstitial spaces between the inter-bonded grains of hard material, at least a portion of the metallic material comprising a metal alloy, having a melting temperature of about seven hundred fifty degrees Celsius (750° C.) or less, the metal alloy comprising two or more elements, a first element of the two or more elements selected from the group consisting of cobalt, iron, and nickel, a second element of the two or more elements selected from the group consisting of dysprosium, yttrium, terbium, gadolinium, germanium, samarium, neodymium, and praseodymium.

26. The earth-boring tool of claim 25, wherein the metal alloy comprises a near-eutectic composition.

27. A method of forming a polycrystalline compact, comprising:

forming an unsintered compact preform comprising a plurality of grains of hard material;

sintering the compact preform in the presence of a catalyst material for catalyzing the formation of inter-granular bonds between the grains of hard material of the plurality of grains of hard material, sintering the compact preform comprising forming a polycrystalline material comprising interbonded grains of hard material formed by bonding together the plurality of grains of hard material;

providing a metal alloy having a melting temperature of about seven hundred fifty degrees Celsius (750° C.) or less in at least some interstitial spaces between the interbonded grains of hard material;

formulating the metal alloy to comprise at least two elements;

selecting a first element of the at least two elements from the group consisting of cobalt, iron, and nickel; and selecting a second element of the at least two elements from the group consisting of dysprosium, yttrium, terbium, gadolinium, germanium, samarium, neodymium, and praseodymium.

28. The method of claim 27, further comprising sintering the compact preform at a pressure greater than about five gigapascals (5.0 GPa) and a temperature greater than about one thousand three hundred degrees Celsius (1,300° C.).

29. The method of claim 28, further comprising selecting the plurality of grains of hard material to comprise a plurality of diamond grains.

30. The method of claim 27, further comprising formulating the metal alloy to comprise a near-eutectic composition.

31. The method of claim 30, further comprising formulating the metal alloy to comprise a eutectic composition.

32. The method of claim 31, further comprising formulating the eutectic composition to comprise one of a binary eutectic composition, a ternary eutectic composition, and a quaternary eutectic composition.

33. The method of claim 30, further comprising formulating the near-eutectic composition to comprise at least one of a near-eutectic composition of cobalt and dysprosium, a near-eutectic composition of cobalt and yttrium, a near-eutectic composition of cobalt and terbium, a near-eutectic composition of cobalt and gadolinium, a near-eutectic composition of cobalt and germanium, a near-eutectic composition of cobalt and samarium, a near-eutectic composition of cobalt and neodymium, and a near-eutectic composition of cobalt and praseodymium.

34. The method of claim 30, further comprising formulating the near-eutectic composition to comprise at least one of a near-eutectic composition of iron and dysprosium, a near-eutectic composition of iron and yttrium, a near-eutectic composition of iron and terbium, a near-eutectic composition of iron and gadolinium, a near-eutectic composition of iron and germanium, a near-eutectic composition of iron and samarium, a near-eutectic composition of iron and neodymium, and a near-eutectic composition of iron and praseodymium.

35. The method of claim 30, further comprising formulating the near-eutectic composition to comprise at least one of a near-eutectic composition of nickel and dysprosium, a near-eutectic composition of nickel and yttrium, a near-eutectic composition of nickel and terbium, a near-eutectic composition of nickel and gadolinium, a near-eutectic composition of nickel and germanium, a near-eutectic composition of nickel and samarium, a near-eutectic composition of nickel and neodymium, and a near-eutectic composition of nickel and praseodymium.

36. The method of claim 27, further comprising formulating the metal alloy to have a melting temperature of about six hundred fifty degrees Celsius (650° C.) or less.

37. The method of claim 36, further comprising formulating the metal alloy to have a melting temperature of between about five hundred fifty degrees Celsius (550° C.) and about six hundred fifty degrees Celsius (650° C.).

38. The method of claim 27, further comprising causing the polycrystalline material to comprise between about eighty percent by volume (80 vol %) and about ninety-nine percent by volume (99 vol %) of the polycrystalline compact.

39. The method of claim 38, further comprising causing the metal alloy to comprise between about one percent by volume (1 vol %) and about twenty percent by volume (20 vol %) of the polycrystalline compact.

40. The method of claim 27, further comprising:

providing the metal alloy in a first region of the polycrystalline material; and forming a second region of the polycrystalline material to be at least substantially free of the metal alloy.

41. The method of claim 27, wherein selecting the first element further comprises selecting the first element to comprise at least a portion of the catalyst material.

42. The method of claim 27, wherein providing the metal alloy in at least some interstitial spaces between the inter-bonded grains of hard material comprises alloying at least a portion of the catalyst material with at least the second element of the at least two elements.

43. The method of claim 27, further comprising removing the metal alloy from at least a portion of the interstitial spaces between the inter-bonded grains of hard material.

44. The method of claim 43, wherein removing the metal alloy comprises heating the metal alloy to a temperature of about seven hundred fifty degrees Celsius (750° C.) or less to melt the metal alloy, and removing the molten metal alloy from the polycrystalline compact prior to using the polycrystalline compact in an earth-boring process.

45. The method of claim 44, wherein removing the metal alloy comprises removing the metal alloy from the polycrystalline compact during use of the polycrystalline compact in an earth-boring process.

* * * * *